US009520278B2

(12) United States Patent
Inagaki et al.

(10) Patent No.: US 9,520,278 B2
(45) Date of Patent: Dec. 13, 2016

(54) NEBULIZER AND ANALYZER

(71) Applicants: NATIONAL INSTITUTE OF ADVANCED INDUSTRIAL SCIENCE AND TECHNOLOGY, Tokyo (JP); S.T. JAPAN INC., Tokyo (JP)

(72) Inventors: Kazumi Inagaki, Ibaraki (JP); Shin-ichiro Fujii, Ibaraki (JP); Shin-ichi Miyashita, Ibaraki (JP); Koichi Chiba, Ibaraki (JP); Takao Nakagawa, Tokyo (JP); Masaaki Abe, Tokyo (JP); Nobuyoshi Kitagawa, Tokyo (JP); Yosuke Nakagawa, Tokyo (JP)

(73) Assignees: NATIONAL INSTITUTE OF ADVANCED INDUSTRIAL SCIENCE AND TECHNOLOGY, Tokyo (JP); S.T. JAPAN INC., Tokyo (JP)

( * ) Notice: Subject to any disclaimer, the term of this patent is extended or adjusted under 35 U.S.C. 154(b) by 51 days.

(21) Appl. No.: 14/597,727

(22) Filed: Jan. 15, 2015

(65) Prior Publication Data

US 2015/0206729 A1 Jul. 23, 2015

(30) Foreign Application Priority Data

Jan. 21, 2014 (JP) ..... 2014-008592

(51) Int. Cl.
*H01J 49/04* (2006.01)
*H01J 49/10* (2006.01)

(52) U.S. Cl.
CPC ..... *H01J 49/045* (2013.01); *H01J 49/105* (2013.01)

(58) Field of Classification Search
CPC combination set(s) only.
See application file for complete search history.

(56) References Cited

U.S. PATENT DOCUMENTS 6,207,954 B1 * 3/2001 Andrien, Jr. ..... H01J 49/0009 250/282
6,485,689 B1 11/2002 Huang et al.
(Continued)

FOREIGN PATENT DOCUMENTS

JP H09-199076 7/1997
JP H11-337526 12/1999
JP 2001-070841 3/2001

OTHER PUBLICATIONS

Aguirre et al., "Compensation for matrix effects on ICP-OES by on-line calibration methods using a new multi-nebulizer based on Flow Blurring technology", Journal of Analytical Atomic Spectrometry, Sep. 13, 2010, pp. 1724-1732.
(Continued)

*Primary Examiner* — Phillip A Johnston
*Assistant Examiner* — Hsien Tsai
(74) *Attorney, Agent, or Firm* — Greenblum & Bernstein, P.L.C.

(57) ABSTRACT

An object is to mix multiple liquids sufficiently and then nebulize the mixed liquids while maintaining the nebulizing efficiency. A nebulizer includes a first inner tube disposed inside an outer tube and having therein a first sample passage through which a first liquid sample flows, a second inner tube disposed inside the outer tube in parallel with the first inner tube and having therein a second sample passage through which a second liquid sample flows, a membranous member disposed with a gap between the membranous member and sample outlets formed at respective ends of the inner tubes. The gap forms mixing space in which a gas passing through a gas passage converts the first and second
(Continued)

liquid samples flowing out of the sample outlets into droplets and mixes the droplets and the membranous member has multiple holes through which the mixed liquid samples pass along with the gas.

5 Claims, 7 Drawing Sheets

(56) References Cited

U.S. PATENT DOCUMENTS

| | | | | |
|---|---|---|---|---|
| 6,511,850 | B1 * | 1/2003 | Vigh | B05B 7/0408 204/452 |
| 2002/0113144 | A1 * | 8/2002 | Huang | B05B 7/066 239/424.5 |
| 2008/0230053 | A1 * | 9/2008 | Kraft | A61M 11/06 128/200.23 |
| 2010/0226821 | A1 * | 9/2010 | Ricciardi | A61L 2/04 422/33 |

OTHER PUBLICATIONS

Pereira et al., "Correction of matrix effects for As and Se in ICP OES using a Flow Blurring multiple nebulizer", Journal of Analytical Atomic Spectrometry, Oct. 10, 2012, pp. 2132-2137.

Kovachev et al., "Development and characterization of a Flow Focusing multi nebulization system for sample introduction in ICP-based spectrometric techniques", Journal of Analytical Atomic Spectrometry, Jun. 16, 2009, pp. 1213-1221.

* cited by examiner

NEBULIZER AND ANALYZER

TECHNICAL FIELD

The present invention relates to a nebulizer, which aerosolizes and ejects a sample, and an analyzer using the nebulizer.

BACKGROUND ART

Optical emission spectrometers and mass spectrometers using a plasma such as an inductively coupled plasma (ICP) as an atomization source or ionization source are known as versatile high-sensitivity elemental analyzers in a wide variety of fields, including material analysis, environmental analysis, and semimicroanalysis.

Conventional ICP-optical emission spectrometers (ICP-OES), ICP-atomic emission spectrometers (ICP-AES), and ICP-mass spectrometers (ICP-MS) aerosolize a liquid sample using a nebulizer in a vaporizing chamber and supply the aerosolized sample to a plasma source to convert it into a plasma in order to keep plasma stable, and then analyze light emitted from the plasma, or ionized sample.

In recent years, nebulizer systems capable of individually simultaneously nebulizing multiple liquids have been often used as a means for performing on-line the internal standard correction method, standard addition method, hydride generation method, or the like. As such technologies, there have been known technologies described in Patent Literature 1 (Japanese Patent Publication No. 1997-199076, paragraphs 0012 to 0014, FIG. 1), Patent Literature 2 (Japanese Patent Publication No. 1999-337526, paragraphs 0009 to 0010, 0019 to 0020, FIGS. 1, 2, and 4), and Patent Literature 3 (Japanese Patent Publication No. 2001-70841, paragraphs 0021 to 0022, FIG. 1) and Non-Patent Literature 1 (M. A. Aguirre et al., J. Anal. At. Spectrom., 2010, 25, 1724-1732), Non-Patent Literature 2 (N. Kovachev et al., J. Anal. At. Spectrom., 2009, 24, 1213-1221), and Non-Patent Literature 3 (C. D. Pereira et al., J. Anal. At. Spectrom., 2012, 27, 2132-2137).

The technology described in Patent Literature 1 nebulizes samples from multiple nebulizers (4) supported on a chamber (1) and ionizes the aerosolized mixed samples using a plasma (21). The nebulizers (4) each include a carrier gas supply unit (10).

In the nebulizer system described in Non-Patent Literature 1, two nebulizers are disposed in parallel or disposed in such a manner that the front ends thereof are inclined at 15 or 30 degrees so as to come close to each other.

The nebulizer system described in Patent Literature 2 nebulizes sample liquids supplied through eight pipes (2) using a gas introduced from one gas inlet (3).

The nebulizer system described in Patent Literature 3 nebulizes sample liquids supplied through multiple capillaries (5) using a gas introduced from one gas inlet (6).

The nebulizer system described in Non-Patent Literature 2 nebulizes liquid samples introduced from individual liquid sample inlets (4) and supplied through four capillaries (7) using a gas introduced from one common gas inlet (3).

The nebulizer system described in Non-Patent Literature 3 nebulizes liquid samples introduced from three liquid inlets using a gas introduced from one gas inlet.

SUMMARY OF INVENTION

Problem to be Solved by the Invention

Problems with Related Art

Performing on-line the internal standard correction method, standard addition method, or hydride generation method requires adding and mixing a standard liquid or reaction liquid to a sample liquid. A conventional method for doing this using a single nebulizer is to merge the tube through which the sample liquid flows and the tube through which the standard liquid or the like flows so that the liquids are mixed in the merged tube. However, the inner diameter of the tube used is 1 mm or less, and the Reynolds number (dimensionless number) thereof, which is an index of viscous force serving as a dominant factor when mixing multiple liquids, falls below 2000, which is a measure to distinguish between turbulent flow and laminar flow. When the multiple liquids form laminar flow, the substances are diffused only around the interface between the liquids. Accordingly, the liquids cannot be mixed sufficiently in the capillary within a short distance and short time. That is, the liquids having different properties, such as liquids having different viscosities, or an organic solvent and an aqueous solution, cannot be mixed quantitatively. As a result, accurate correction cannot be made, or an accurate calibration curve cannot be made.

One conceivable method for generating turbulent flow is to form the junction (adapter) of the tubes into an arrow shape, Y-shape, T-shape, or the like to make turbulent flow more likely to occur at the junction to improve the mixing efficiency. However, the liquids having different properties are difficult to mix sufficiently. For example, the liquids flow through the merged tube in the form of separated layers or in the form of an organic solvent (oil), aqueous solution (water), organic solvent (oil), and the like (in plug form).

Combined multiple nebulizers described in Patent Literature 1 and Non-Patent Literature 1 and multiple nozzles described in Patent Literature 2 and 3 and Non-Patent Literature 2, 3 individually nebulize multiple liquids and therefore eliminate the need to mix the liquids in the tube and solve the problems with mixing of the liquids in the tube.

However, the optimum flow rate of a gas supplied to a plasma is predetermined. For Patent Literature 1 and Non-Patent Literature 1, the respective gas flow rates of the multiple nebulizers must be set such that the sum of the gas flow rates is optimized. Accordingly, the gas flow rate per nebulizer is reduced. As a result, a gas flow rate required to fine aerosolize each sample liquid may not be obtained. That is, the technologies described in Patent Literature 1 and Non-Patent Literature 1 have a nebulizing efficiency reduction problem.

Similarly, the nozzles (capillaries) described in Patent Literature 2, 3 and Non-Patent Literature 2, 3 all aerosolize liquids from each nozzles using a gas introduced from one gas inlet and therefore the flow rate of the gas per nozzle is reduced. As a result, a gas flow rate required to nebulize each liquid may not be obtained, which may reduce the nebulizing efficiency.

Further, if the multiple nebulizers described in any of Patent Literature 1 to 3 and Non-Patent Literature 1 to 3 are used in the method of adding multiple reagents to a sample liquid and introducing the resulting reactant into a plasma, such as the hydride generation method (the resulting reactant is a hydrogen gas in the hydride generation method), it is necessary to cause the aerosolized minute droplets to come into contact and react with each other. Causing the aerosolized small droplets to come into contact and collide with each other is less efficient than mixing the liquids in the tube and makes many unreacted droplets more likely to remain. Accordingly, the technologies described in Patent Literature 1 to 3 and Non-Patent Literature 1 to 3 fail to obtain a sufficient amount of reaction products and have difficulty in performing high-efficiency, high-sensitivity analysis.

A technical object of the present invention is to mix multiple liquids sufficiently and nebulize the mixed liquids while maintaining the nebulizing efficiency.

Means for Solving Problem

The invention according to a first aspect provides a nebulizer comprising, a nebulizer includes an outer tube having a nebulizing outlet at one end thereof; a first inner tube disposed inside the outer tube and extending in an axis direction of the outer tube, wherein a gas passage through which a nebulizing gas flows is formed between the first inner tube and outer tube and wherein the first inner tube has therein a first sample passage through which a first liquid sample flows; a second inner tube disposed inside the outer tube in parallel with the first inner tube, wherein a gas passage through which a nebulizing gas flows is formed between the second inner tube and outer tube and wherein the second inner tube has therein a second sample passage through which a second liquid sample flows; and a membranous member disposed with a gap between the membranous member and sample outlets formed at respective ends of the inner tubes, wherein the gap forms mixing space in which a gas passing through the gas passage converts the first and second liquid samples flowing out of the sample outlets into droplets and mixes the droplets and wherein the membranous member has multiple holes through which mixed liquid samples obtained by mixing the first and second liquid samples using the gas that has become turbulent in the mixing space pass along with the gas.

The invention according to a second aspect provides a nebulizer according to the first aspect, wherein a length of the gap between the sample outlets and the membranous member is set to a length which does not cause intermittent nebulizing of the mixed liquid samples or shorter length.

The invention according to a third aspect provides a nebulizer according to the first or second aspect, wherein a sum of perimeter lengths of the holes of the membranous member is set to a length larger than a perimeter length of the nebulizing outlet.

The invention according to a fourth aspect provides a nebulizer according to any one of the aspects 1 to 3, wherein the membranous member is formed by weaving fibers, and the holes are gaps among the fibers.

The invention according to a fifth aspect provides an analyzer comprising, an analyzer includes the nebulizer of any one of the aspects 1 to 4, a plasma source configured to receive an aerosolized sample nebulized from the nebulizer, the aerosolized sample being a sample from which components have been separated, and to atomize or ionize the sample, and a spectrometer configured to analyze the atomized or ionized sample.

Effect of the Invention

According to the invention described in the first and fifth aspects, it is possible to mix the multiple liquids sufficiently and nebulize the mixed liquids while maintaining the nebulizing efficiency.

According to the invention described in the second aspect, the mixed liquid samples can be nebulized stably.

According to the invention described in the third aspect, the sample droplets to be nebulized can be made smaller.

According to the invention described in the fourth aspect of the present invention, a fiber-woven low-cost membranous member can be obtained.

DESCRIPTION OF EMBODIMENTS

Now, an embodiment of the present invention will be described with reference to the drawings. However, the present invention is not limited to thereto.

Throughout the drawings, members other than those required for the description are omitted as appropriate to clarify the description.

First Embodiment

Figure 1:
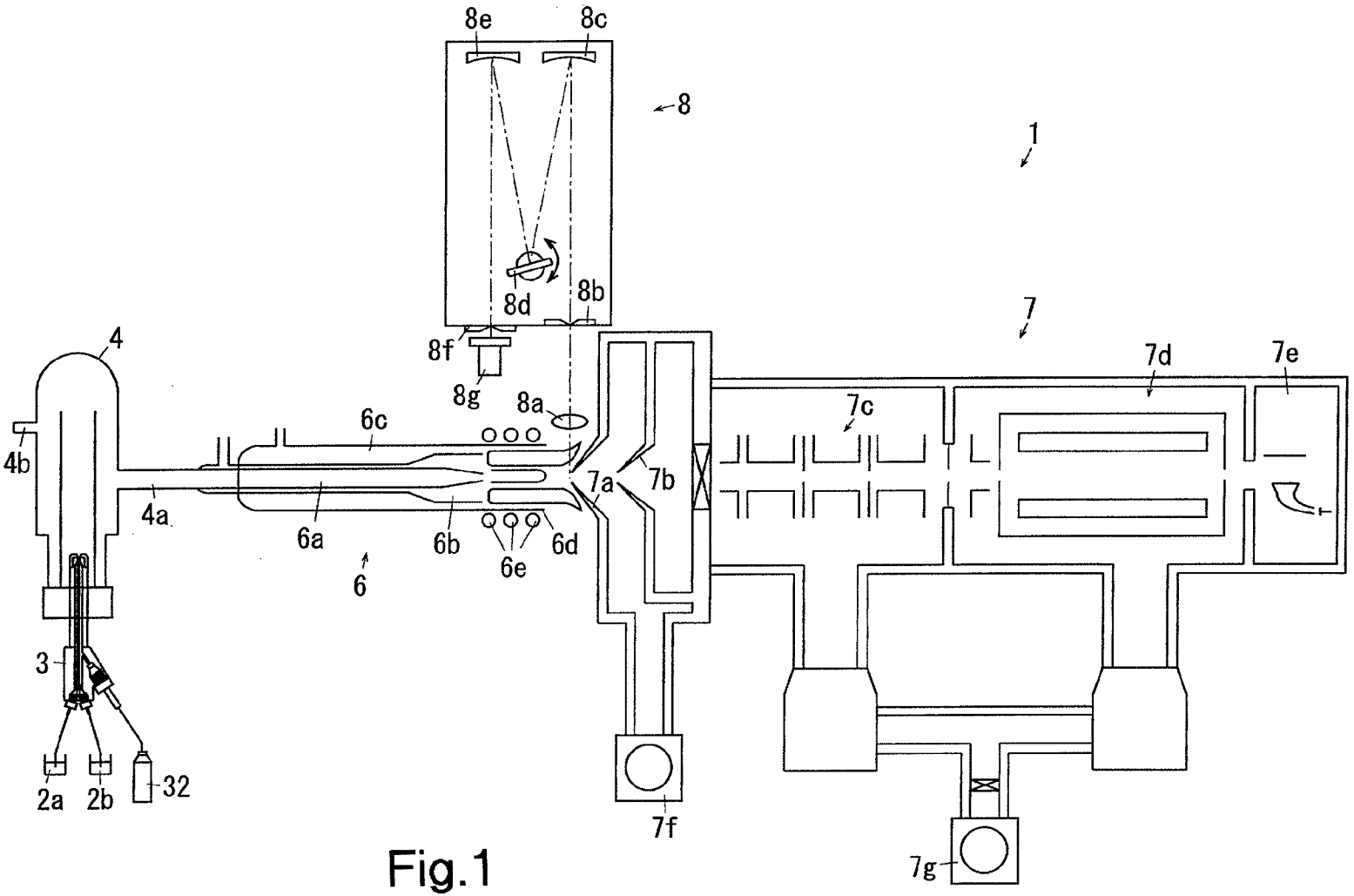
FIG. 1 is a diagram showing an analyzer of a first embodiment.

FIG. 1 is a diagram showing an analyzer of a first embodiment of the present invention. In FIG. 1, an analyzer 1 of the first embodiment includes a first sample container 2*a* containing a first sample and a second sample container 2*b* containing a second sample. Liquid samples are contained in the sample container 2*a*,2*b*. In the specification and claims of the present application, liquid samples refers to samples in liquid form, including liquids in which a solid sample is dispersed, suspended, dissolved, or in other forms. Connected to the sample containers 2*a*, 2*b* is a nebulizer 3. Details of the nebulizer 3 will be described later. The front end of the nebulizer 3 is supported by a vaporizing chamber 4. The vaporizing chamber 4 has a transport passage 4*a* for transporting an aerosolized sample nebulized by the nebulizer 3 and an exhaust passage 4*b* for discharging a waste liquid.

Connected to the transport passage 4*a* is a plasma torch 6, which is an example of a plasma source. The plasma torch 6 has a triple-tube structure, that is, has a sample gas passage 6*a* which is connected to the transport passage 4*a* and through which an aerosolized sample passes, an auxiliary gas passage 6*b* which is formed around the perimeter of the sample gas passage 6*a* and through which an auxiliary gas such as argon (Ar) passes, and a plasma gas passage 6*c* which is formed around the perimeter of the auxiliary gas passage 6*b* and through which a plasma gas such as argon (Ar) passes. The plasma torch 6 has, at the front end 6*d* thereof, a coil 6*e* for generating an induction plasma and thus can supply high-frequency power for generating an electric field for converting an argon gas into a plasma.

Disposed adjacent to the front end of the plasma torch 6 is amass spectrometer 7, which is an example of a spectrometer. The plasma (ionized) sample is introduced into the mass spectrometer 7 through a sampling cone 7*a* and a skimmer cone 7*b*, converged using an ion lens 7*c*, and loaded the converged ions into a mass spectrometry unit 7*d* consist of a quadrupole mass filter. Ions separated by the mass spectrometry unit 7*d* are detected by an ion detector 7*e*. The mass spectrometer 7 of the first embodiment also includes a rotary pump 7*f*, which is an example of an exhaust device for exhausting air between the sampling cone 7*a* and skimmer cone 7*b*, and a turbo-molecular pump 7*g*, which is an example of an exhaust device for exhausting air from the ion lens 7*c* and mass spectrometry unit 7*d*.

While a quadrupole mass spectrometer (Q-MS) is used as the mass spectrometer 7 of the first embodiment, any other conventional known mass spectrometers may be used.

Disposed on a side of the front end of the plasma torch 6 is an optical emission spectrometer 8, which is an example of a spectrometer. The optical emission spectrometer 8 of the first embodiment includes a focusing system 8*a* configured to focus emitted light, an entrance slit configured to narrow the light focused by the focusing system 8*a*, a concave mirror 8*c* configured to reflect the light that has passed through the entrance slit 8*b*, a diffraction grating 8*d* configured to diffract the light reflected by the concave mirror 8*c*, a concave mirror 8*e* configured to reflect the light diffracted by the diffraction grating 8*d*, an exit slit Of configured to narrow the light reflected by the concave mirror 8*e*, and a detector 8*g* configured to detect the light which has passed through the exit slit 8*f*.

The optical emission spectrometer 8 of the first embodiment is not limited to the above configuration and may be any other conventional known optical emission spectrometers.

Nebulizer

Figure 2:
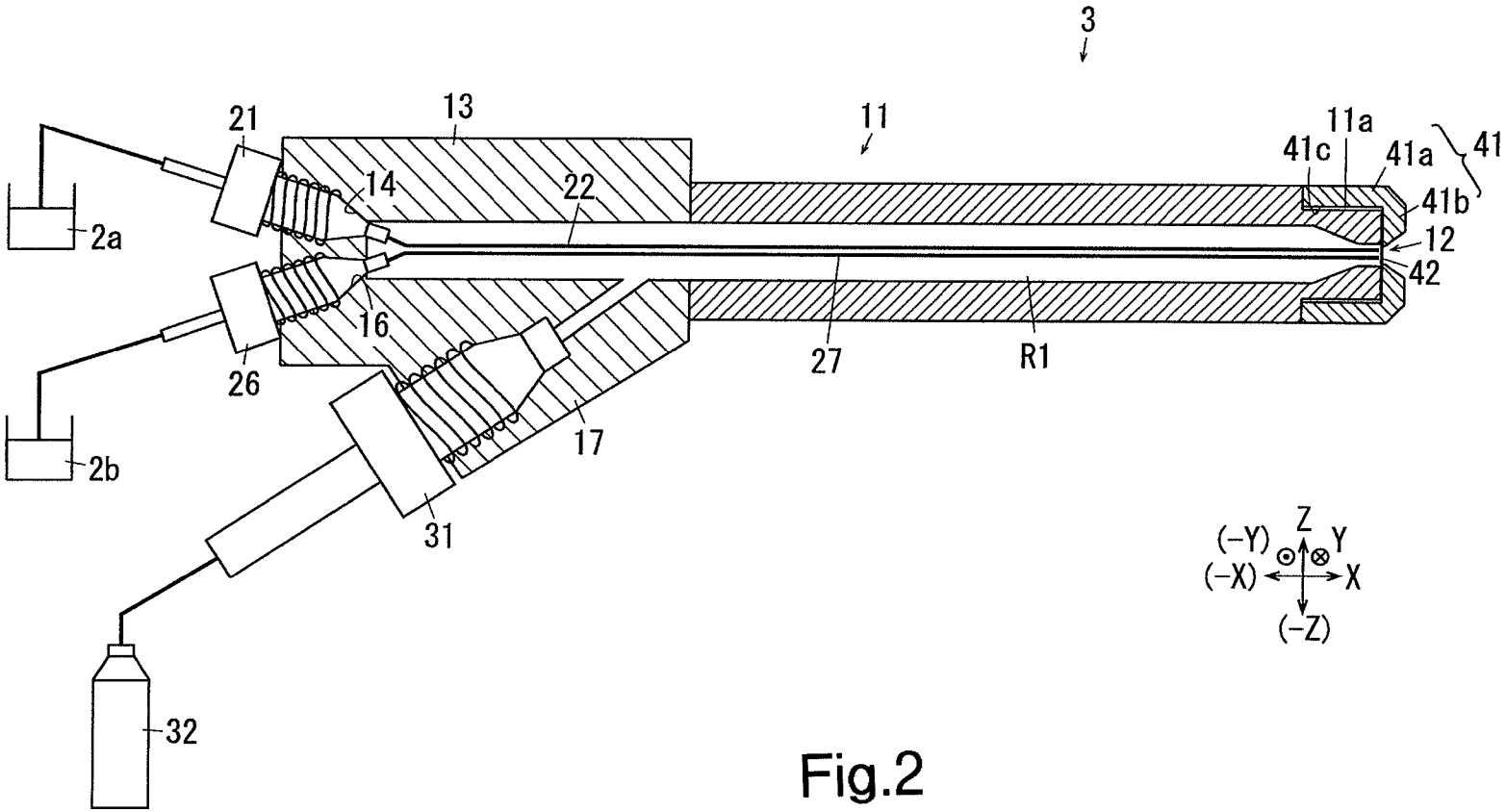
FIG. 2 is an overall view of a nebulizer of the first embodiment.

FIG. 2 is an overall view of the nebulizer of the first embodiment.

Figure 3:
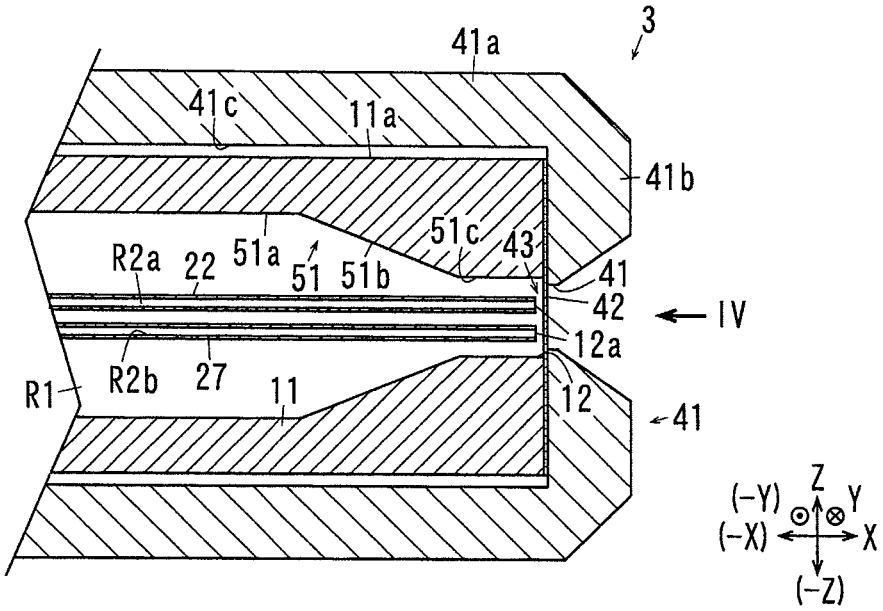
FIG. 3 is an enlarged view of the front end of the nebulizer of the first embodiment.

FIG. 3 is an enlarged view of the front end of the nebulizer of the first embodiment.

Figure 4:
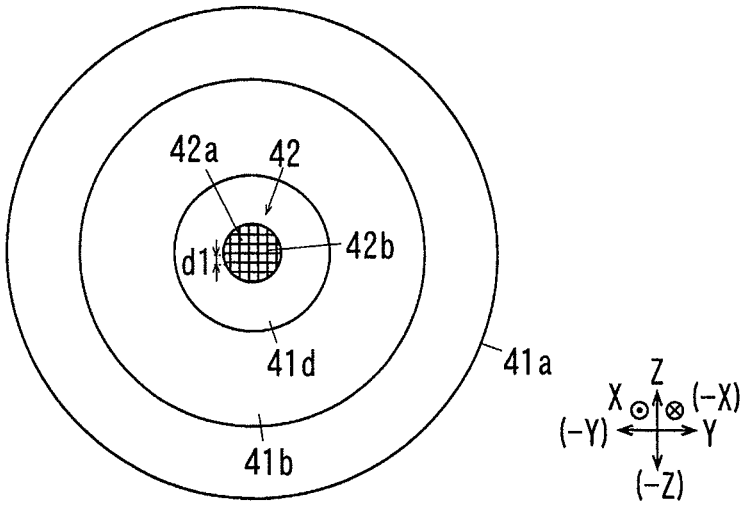
FIG. 4 is a drawing of the nebulizer seen in the direction of an arrow IV in FIG. 3.

FIG. 4 is a view of the nebulizer seen in the direction of an arrow IV in FIG. 3.

To clarify the description, the front-back direction, horizontal direction, and vertical direction in the drawings are defined as an x-axis direction, a y-axis direction, and a z-axis direction, respectively. The directions or sides shown by arrows X, −X, Y, −Y, Z, and −Z are defined as a forward direction, a backward direction, a rightward direction, a leftward direction, an upward direction, and a downward direction, respectively, or a front side, a back side, a right side, a left side, an upper side, and a lower side, respectively.

Further, throughout the drawings, "•" drawn in "○" means an arrow directed from the back to the front of the drawing, and "x" drawn in "○" means an arrow directed from the front to the back of the drawing.

In FIG. 2, the nebulizer 3 of the first embodiment includes a hollow, cylindrical outer tube 11 having a gas passage R1 therein. In FIGS. 2, 3, the outer tube 11 has a nebulizing outlet 12 at the front end thereof. The outer tube 11 also has, on the outer surface of the front end, a screw part 11*a*, which is an example of a fastening part.

The outer tube 11 also has, at the base end 13 thereof, a first inner tube insertion part 14 and a second inner tube insertion part 16. The first inner tube insertion part 14 and second inner tube insertion part 16 are inclined so that the front ends thereof come close to each other, and the front ends reach the gas passage R1. The inner tube insertion parts 14, 16 also have screw grooves for insertion on the inner peripheral surfaces thereof. The outer tube 11 has a gas introduction part 17 in the central part thereof in the front-back direction (x-axis direction). The gas introduction part 17 is diagonally separated from the gas passage R1 and is an example of a fluid introduction part. The gas introduction part 17 has a screw groove for insertion on the inner peripheral surface of the outer end thereof.

In FIGS. 2, 3, a first adapter 21, which is an example of a first inner tube support member, is inserted into the first inner tube insertion part 14. The first adapter 21 has, on the outer surface thereof, a screw thread corresponding to the screw groove of the first inner tube insertion part 14. Thus, the first adapter 21 is detachably screwed into the first inner tube insertion part 14. A first capillary tube 22, which is an example of a first inner tube, is supported by the first adapter 21. The first capillary tube 22 extends to the vicinity of the nebulizing outlet 12 along the gas passage R1. The base end of the first capillary tube 22 penetrates through the first adapter 21 and extends to the outside. In FIG. 1, the outer end of the first capillary tube 22 is connected to the first sample container 2*a*. The first capillary tube 22 has therein a first sample passage R2*a* through which the first liquid sample contained in the first sample container 2*a* flows.

A second adapter 26, which is an example of a second inner tube support member, and a second capillary tube 27, which is an example of a second inner tube, are supported by the second inner tube insertion part 16. The second adapter 26 and second capillary tube 27 are configured in a similar manner to the first adapter 21 and first capillary tube 22, respectively. The second capillary tube 27 has therein a second sample passage R2*b* through which the liquid sample contained in the second sample container 2*b* flows. The second capillary tube 27 is disposed inside the gas passage R1 in parallel with the first capillary tube 22. A gas adapter 31, which is an example of a connecting member for a gas, is inserted into the gas introduction part 17. The gas adapter 31 has, on the outer surface thereof, a screw thread corresponding to the screw groove of the gas introduction part 17. Thus, the gas adapter 31 is screwed into the gas introduction part 17. The outer end of the gas adapter 31 is connected to a gas cylinder 32, which is an example of a nebulizing gas source. The gas cylinder 32 supplies a gas to the gas passage R1 at a predetermined flow rate.

In FIG. 3, the nebulizer 3 of the first embodiment has a mesh holder 41 supported by the front end of the outer tube 11. The mesh holder 41 is an example of a membraneous member holder. The mesh holder 41 of the first embodiment includes a hollow tube 41*a* and a tabular holder 41*b* disposed at the front end of the tube. The tube 41*a* has, on the inner peripheral surface thereof, a screw 41*c* which is fastened to the screw 11*a* of the outer tube 11. The holder 41*b* has an opening 41*d* corresponding to the nebulizing outlet 12. In the first embodiment, the opening 41*d* is formed in such a manner that the inner diameter thereof closer to the outside is larger.

A mesh sheet 42, which is an example of a membraneous member, is supported inside the holder 41*b*. The mesh sheet 42 of the first embodiment is disposed in a manner corresponding to the forward direction of the nebulizing outlet 12 with the outer edge thereof supported by the holder 41*b*. The screw 41*c* of the mesh holder 41 is fastened to the screw 11*a* of the outer tube 11 with the mesh sheet 42 sandwiched between the mesh holder 41 and the front end of the outer tube 11. Thus, the mesh sheet 42 is held so as to be spaced from front ends of the capillary tubes 22, 27. As a result, mixing space 43 is formed between the capillary tubes 22, 27 and mesh sheet 42.

In the first embodiment, the distance between the mesh sheet 42 and capillary tubes 22, 27 is set to 100 μm, but is not limited thereto. The distance may be set to any distance unless droplets are nebulized in a pulsed manner (droplets are nebulized intermittently). Preferably, the distance is set to about 5 to 300 μm.

When the distance between the mesh sheet 42 and capillary tubes 22, 27 is too large (the mixing space 43 is too large), the liquid supply rate is reduced compared to the gas flow rate. Thus, the mixing space 43 is filled with a gas before a sufficient amount of liquid is not supplied to the mixing space 43. As a result, a non-liquid-mixed gas and a liquid-mixed gas are alternately nebulized, that is, droplets are nebulized in a pulsed manner. The pulsed nebulizing of droplets prevents droplets from being constantly supplied to a plasma, thereby having an adverse effect on analysis. In contrast, when the distance is too small, too large an amount of liquid is supplied to the mixing space 43. This makes droplets more likely to be nebulized in a state in which the droplets are not sufficiently broken or mixed with a gas.

For this reason, in the first embodiment, the distance between the mesh sheet 42 and capillary tubes 22, 27 is set to the distance which does not cause pulsed nebulizing of droplets and allows droplets to be mixed with a gas sufficiently.

As shown in FIG. 4, the mesh sheet 42 of the first embodiment is a sheet in which nylon fibers 42*a*, which are an example of a resin, are woven and holes 42*b* are formed among the fibers. When the size d1 of each hole 42*b* is too small, the liquid is more likely to clog; when the size d1 is too large, the diameters of droplets to be nebulized become too large. For this reason, d1 of the sheet used in the first embodiment is set to 20 μm. The size d1 is preferably 5 to 50 μm.

Further, the sum of the perimeter lengths of all the holes 42*b* (the perimeter length of each hole 42*b*×the total number of holes 42*b*) is preferably larger than the perimeter length (circumferential length) of the nebulizing outlet 12. In the sheet used in the first embodiment, the sum of the perimeter lengths of the holes 42*b* is about 1.5 times larger than the perimeter length of the nebulizing outlet 12.

As shown in FIG. 3, in the nebulizer 3 of the first embodiment, an inner peripheral surface 51 at the front end of the outer tube 11 includes an inner peripheral surface 51*a* on the side of the base end, a slope 51*b* like that of a cone, and an inner peripheral surface 51*c* on the front-end side of the slope 51*b*. Thus, the sectional area of the gas passage R1 corresponding to the slope 51*b* becomes smaller as the sectional area comes closer to the front end. The sectional area corresponding to the inner peripheral surface 51*c* is smaller than that corresponding to the inner peripheral surface 51*a*. The sample outlets of the ends of the capillary tubes 22, 27 are located in a region corresponding to the inner peripheral surface 51*c*, which is adjacent to the front end.

Effects of First Embodiment

The nebulizer 3 of the first embodiment supplied argon (Ar) gas, which is an example of a nebulizing gas, from the gas introduction part 17, aerosolizes liquid samples flowing out of the ends of the capillary tubes 22, 27, and nebulizes the aerosolized samples from the opening 41*d* into the vaporizing chamber 4. The nebulized samples are then converted into a plasma (ionized, atomized) in the plasma torch 6 and then measured and analyzed in the mass spectrometer 7 and optical emission spectrometer 8.

In the nebulizer 3 of the first embodiment, the mesh sheet 42 is disposed in front of the capillary tubes 22, 27 and serves as a resistance to small droplets nebulized from the capillary tubes 22, 27 toward the vaporizing chamber 4, unlike conventional nebulizers, including no mesh sheet 42. Thus, a back pressure is applied to the inside of the mesh sheet 42, and a gas coming from the upstream of the gas passage R1 is disturbed in the mixing space 43 inside the mesh sheet 42 and easily becomes turbulent. The first and second sample liquids flowing out of the capillary tubes 22, 27 are disturbed and converted into droplets in the turbulent mixing space 43 and are easily sufficiently mixed. That is, it is easy to obtain mixed-sample droplets where the first and second liquid samples are dispersed uniformly. In particular, when the first and second liquid samples are caused to react to each other as is done in the hydride generation method, a sufficient reaction is more likely to occur than in conventional nebulizers. Accordingly, a reaction product is more easily obtained than in conventional nebulizers.

When the sufficiently mixed, aerosolized sample droplets pass through the mesh sheet 42, they are made smaller. Thus, the sample droplets having a reduced mean particle diameter are nebulized from the opening 41*d*. In the present specification, the mean particle diameter refers to a particle diameter at a volumetric integrated rate of 50% in a particle size distribution obtained by the laser diffraction/scattering method.

At this time, the flow rate of the gas, which converts the liquid samples flowing out of the sample outlets of the ends of the capillary tubes 22, 27 into droplets, passes through the opening 41*d* and mesh sheet 42, and enters the vaporizing chamber 4, is controlled based on the amount of gas supplied from the gas cylinder 32. Accordingly, the nebulizer 3 of the first embodiment can obtain the gas at a flow rate most suitable for a plasma compared to conventional nebulizers. Further, even when the particle diameter of droplets converted from the liquid samples flowing out of the sample outlets of the capillary tubes 22, 27 is large to some extent, the droplets are made smaller when passing through the mesh sheet 42. Thus, reductions in the nebulizing efficiency can be prevented.

As seen above, the nebulizer 3 of the first embodiment sufficiently mixes the first and second liquid samples, obtains a gas flow rate most suitable for a plasma, and maintains the nebulizing efficiency. Thus, high-sensitivity, high-accuracy analysis can be performed.

Further, in the nebulizer 3 of the first embodiment, the sectional area of the gas passage R1 corresponding to the inner peripheral surface 51, which is adjacent to the front end of the outer tube 11, is smaller than the sectional area of the gas passage R1 corresponding to the base end thereof. This prevents the ends of the capillary tubes 22, 27 from significantly vibrating due to the gas supplied from the gas cylinder 32. As a result, the sample droplets can be nebulized stably compared to configurations where the sectional area of the gas passage does not become smaller at the front end.

Further, for a configuration where the sectional area does not become larger than that at the base end, if the number of capillary tubes is increased, the gas pressure in the gas passage R1 may become excessive. In the nebulizer 3 of the first embodiment, however, the sectional area at the base end is larger, thereby preventing the gas pressure from becoming excessive.

Further, in the nebulizer 3 of the first embodiment, the inner peripheral surface 51*c* at the front end of the outer tube 11 is a cylindrical surface having the same inner diameter, and the ends of the capillary tubes 22, 27 are located within the range of the inner peripheral surface 51*c* at the front end. Accordingly, the mixing space 43, which includes no capillary tubes 22, 27, is larger in sectional area than the space closer to the upstream side, which includes the capillary tubes 22, 27. If the inner peripheral surface 51*c* is a conical surface, which becomes narrower in positions closer to the front end, the gas pressure would become higher in positions closer to the front end of the outer tube 11. Thus, the gas pressure in the mixing space 43 might become excessive. In the first embodiment, the mixing space 43 on the downstream side is wider in sectional area than the space on the upstream side and thus the gas pressure can be prevented from becoming excessive.

In a configuration including no mesh sheet 42, coarse, uneven sample droplets generated in the mixing space 43 are nebulized and supplied to a plasma. That is, the sample droplets are unstably supplied to a plasma. In the first embodiment including the mesh sheet 42, on the other hand, when the sample droplets pass through the mesh sheet 42, they contact the fibers 42*a* and are broken into smaller droplets. Thus, the sample droplets can be stably supplied to a plasma. Note that if the holes 42*b* are reduced in size, the sample droplets are more effectively broken into smaller droplets when contacting the fibers 42*a*. However, reducing the holes 42*b* in size increases the pressure (back pressures) in the mixing space 43. Accordingly, there is a limit to reducing the holes 42*b* in size.

Further, in the nebulizer 3 of the first embodiment, the mesh sheet 42 is formed in such a manner that the sum of the perimeter lengths of the holes 42*b* is larger than the perimeter length of the nebulizering outlet 12. Accordingly, when a gas passes through the holes 42*b*, a turbulent flow (eddy) is more likely to occur along the perimeters (inner edges) of the holes 42*b*. The turbulent flow further mixes the gas and liquids, as well as further breaks the droplets into smaller droplets. As seen above, the first embodiment produces a droplet breakage effect using the fibers 42*a* of the mesh sheet 42, as well as a produces a droplet breakage effect using the turbulent flow.

Experimental Examples

Experiments were performed to examine the functions of the nebulizer of the first embodiment.

Experimental Example 1-1

In Experimental Example 1-1, an arsenic standard solution ($As_2O_3$ and NaOH in water pH 5.0 with HCl) was used as the first liquid sample, and a sodium borohydride ($NaBH_4$) solution was used as the second liquid sample. Then arsenic was measured. The concentration of the arsenic standard solution was set to 3 mg/L, and the concentration of the sodium borohydride solution was set to 0.5% wt/wt. In Experimental Example 1-1, the arsenic standard solution was supplied at 0.25 mL/min, and the sodium borohydride solution was supplied at 0.25 mL/min. Argon (Ar) was used as a nebulizing gas. An ICP-OES was used as a measuring instrument.

Experimental Example 1-2

In Experimental Example 1-2, pure water was used as the second liquid sample and supplied at 0.25 mL/min. The other conditions were same as those in Experimental Example 1-1.

Comparative Example 1-1

In Comparative Example 1-1, an arsenic standard solution was nebulized using a conventional concentric nebulizer available from MEINHARD. The arsenic standard solution was supplied at 0.5 mL/min. The other conditions were same as those in Experimental Example 1-1.

Figure 5:
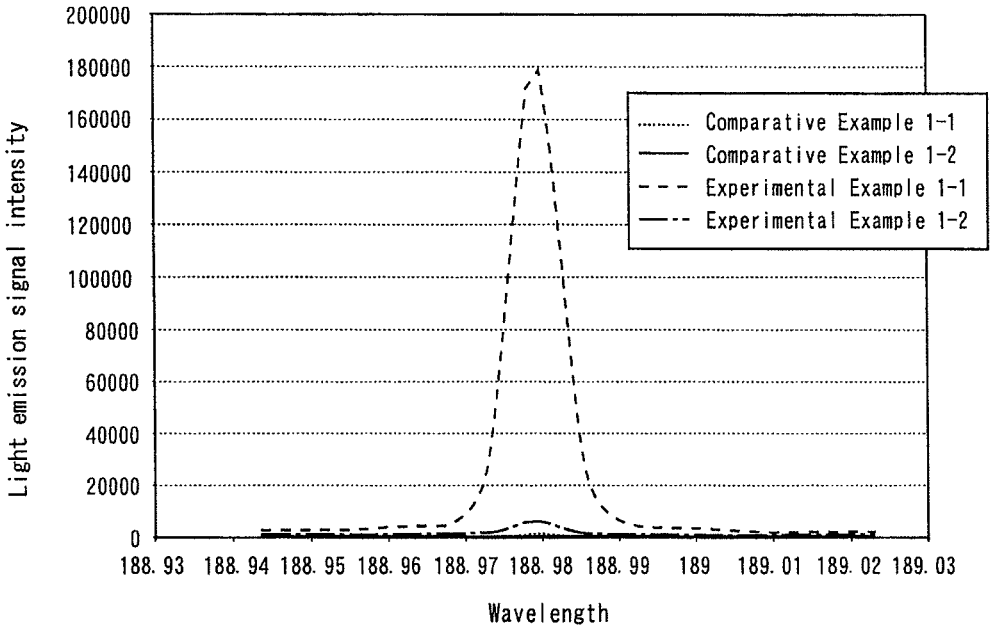
FIG. 5 is a graph showing experiment results in which the horizontal axis represents wavelength and the vertical axis represents the intensity of a light emission signal of ICP-OES.

FIG. 5 is a graph showing the experiment results in which the horizontal axis represents wavelength and the vertical axis represents the intensity of alight emission signal of ICP-OES.

In FIG. 5, a very strong signal was observed in the wavelength (around 188.98 nm) of arsenic in Experimental Example 1-1. It is believed that arsine ($AsH_3$) generated by reaction between the arsenic standard solution and sodium borohydride solution was introduced into a plasma and thus arsenic (As*) was excited and observed. In Experimental Example 1-2, a signal weaker than that in Experimental Example 1-1 but stronger than that in Comparative Example 1-1 was observed. It is believed that $H_3AsO_3$ in the arsenic standard solution was introduced into a plasma and thus arsenic (As*) was excited and observed.

Subsequently, the signal intensities were compared. The signal intensity of Experimental Example 1-1 is about 105 times higher than that of Comparative Example 1-1, and the signal intensity of Experimental Example 1-2 was about four times higher than that of Comparative Example 1-1. That is, the nebulizers of Experimental Examples 1-1, 1-2 were confirmed to be improved in sensitivity compared to the conventional nebulizers.

Particularly, in Experimental Example 1-2, although the arsenic standard solution was mixed with pure water and thus the arsenic concentration was substantially reduced, the signal intensity was improved. The improvements in signal intensity directly reflect improvements in the efficiency of introducing droplets into a plasma through the vaporizing chamber and indicates that the nebulizer 3 of the first embodiment can generate smaller droplets than the conventional nebulizers and thus increase the amount of droplets passing through the vaporizing chamber.

Experimental Example 2

In Experimental Example 2, an experiment was performed with respect to the distance between the capillary tubes 22, 27 and mesh sheet 42. In Experimental Example 2, pure water was used as a sample liquid under conditions similar to Experimental Example 1; the distance between the capillary tubes 22, 27 and mesh sheet 42 was changed in units of 100 μm; the mean particle diameter of nebulized droplets was measured three times per second; and the nebulizing stability was examined. As in Experimental Example 1-2 and Comparative Example, the sample liquid was supplied at 0.5 mL/min.

Figure 6:
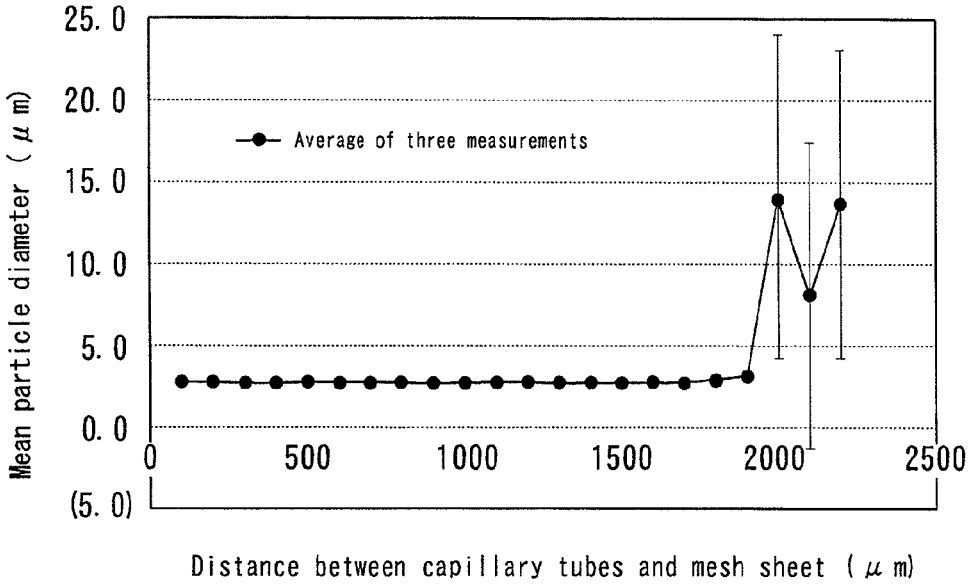
FIG. 6 is a graph showing experiment results in which the horizontal axis represents the distance between capillary tubes and a mesh sheet and the vertical axis represents the mean particle diameter of nebulized droplets.

FIG. 6 is a graph showing the experiment results in which the horizontal axis represents the distance between the capillary tubes 22, 27 and mesh sheet 42 and the vertical axis represents the mean particle diameter of nebulized droplets.

As shown in FIG. 6, in Experimental Example 2, when the distance was less than 2000 μm (2 mm), droplets were nebulized stably and the mean particle diameter of the nebulized droplets hardly varied; when the distance became 2000 μm or more, droplets were nebulized in a pulsed manner and the mean particle diameter significantly varied.

Note that when the amount of the sample liquid supplied was changed to 2 mL/min, droplets were nebulized stably even with a distance of 3 mm or 4 mm.

Accordingly, the distance between the capillary tubes 22, 27 and mesh sheet 42 can be changed in accordance with the amount of the sample liquid supplied unless droplets are nebulized in a pulsed manner.

Modification

While the embodiment of the present invention has been described in detail, the invention is not limited thereto. Various changes can be made to the embodiment without departing from the spirit and scope of the invention as set forth in the claims. Modifications (H01) to (H06) of the embodiment are described below.

(H01) The specific numeric values or materials described in the embodiment are not limiting and can be changed as appropriate in accordance with the design, specification, purpose, or the like.

(H02) While the analyzer 1 including both the mass spectrometer 7 and optical emission spectrometer 8 has been described in the embodiment, other configurations may be employed. For example, the analyzer 1 may include only one of those or may include spectrometers other than those.

Figure 7:
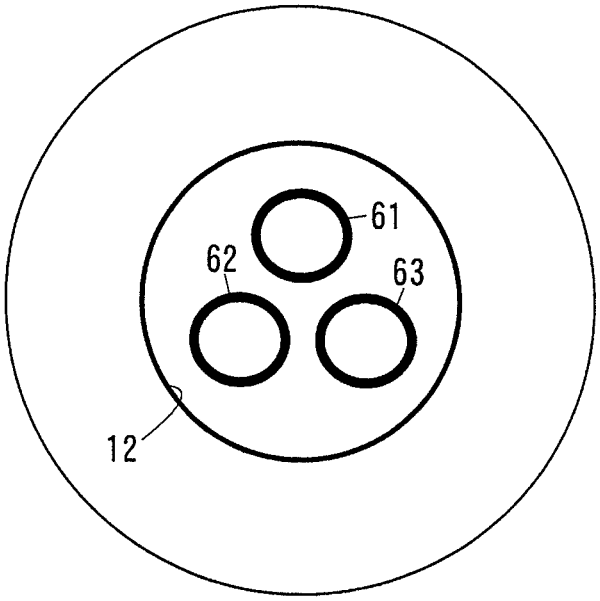
FIG. 7 is a diagram showing a modification of the present application.

FIG. 7 is a diagram showing a modification of the present application.

(H03) While the configuration where the two capillary tubes 22, 27 are provided has been described in the embodiment, other configurations may be employed. For example, as shown in FIG. 7, three capillary tubes, 61 to 63, may be provided, or four or more capillary tubes may be provided.

(H04) A pump for sending a liquid sample may be provided in the embodiment. There may be also employed a configuration where an eluent is sent using a liquid sending pump, and a sample is injected into the eluent using an injector.

(H05) While the fiber-woven mesh sheet 42 has been described as an example of a membranous member in the embodiment, other types of membranous members may be used. For example, there may be used a membranous member formed by making holes in a film using a laser, punch, or the like.

(H06) The combinations of the first and second liquid samples described in the embodiment are not limiting. There may be used other combinations, including a combination of a unknown sample and an internal standard substance added in the internal standard method or a standard substance added in the standard addition method and a combination of a unknown sample (e.g., a blood in a blood test) and a reactive substance which chemically reacts with a component which is desired to be measured in the unknown sample.

What is claimed is:

1. A nebulizer comprising:

an outer tube having a nebulizing outlet at one end thereof;

a first inner tube disposed inside the outer tube and extending in an axis direction of the outer tube, wherein a gas passage through which a nebulizing gas flows is provided between the first inner tube and outer tube and wherein the first inner tube has therein a first sample passage through which a first liquid sample flows;

a second inner tube disposed inside the outer tube in parallel with the first inner tube, wherein a gas passage through which the nebulizing gas flows is provided between the second inner tube and outer tube, and wherein the second inner tube has therein a second sample passage through which a second liquid sample flows; and a membranous member disposed at downstream ends of sample outlets in a transport direction of the first and second sample passages and disposed, such that a gap is provided between the membranous member and the sample outlets provided at respective ends of the first and second inner tubes, wherein the gap provides a mixing space, in which the nebulizing gas passing through the gas passages converts the first and second liquid samples flowing out of the sample outlets into droplets and mixes the droplets to provide a mixed liquid sample, wherein the nebulizing gas becomes turbulent in the mixing space to mix the droplets, and wherein the membranous member has a plurality of holes through which the mixed liquid sample samples passes along with the nebulizing gas for nebulization.

2. The nebulizer of claim 1, wherein a length of the gap between the sample outlets and the membranous member is set to a length which does not cause intermittent nebulizing of the mixed liquid samples or to a shorter length.

3. The nebulizer of claim 1, wherein a sum of perimeter lengths of the holes of the membranous member is set to a length larger than a perimeter length of the nebulizing outlet.

4. The nebulizer of claims 1, wherein the membranous member includes woven fibers, and wherein the holes are gaps among the woven fibers.

5. An analyzer comprising:

the nebulizer of claim 1;

a plasma source configured to receive an aerosolized sample nebulized from the nebulizer, the aerosolized sample being a sample from which components have been separated, and to atomize or ionize the sample; and a spectrometer configured to analyze the atomized or ionized sample.

* * * * *